US009072359B2

(12) United States Patent
Agoro

(10) Patent No.: US 9,072,359 B2
(45) Date of Patent: Jul. 7, 2015

(54) WIG DRYING APPARATUS AND METHOD

(71) Applicant: Kimberly Agoro, Fort Worth, TX (US)

(72) Inventor: Kimberly Agoro, Fort Worth, TX (US)

( * ) Notice: Subject to any disclaimer, the term of this patent is extended or adjusted under 35 U.S.C. 154(b) by 143 days.

(21) Appl. No.: 14/030,539

(22) Filed: Sep. 18, 2013

(65) Prior Publication Data

US 2015/0075028 A1 Mar. 19, 2015

(51) Int. Cl.
*F26B 21/00* (2006.01)
*A45D 20/46* (2006.01)
*A45D 44/14* (2006.01)

(52) U.S. Cl.
CPC ..... *A45D 20/46* (2013.01); *A45D 44/14* (2013.01)

(58) Field of Classification Search
CPC ..... F26B 3/00; F26B 5/00; F26B 19/00; F26B 21/00; F26B 21/20; A45D 20/00; A45D 20/22; A45D 20/46; A45D 44/00; A45D 44/14
USPC ..... 34/433, 437, 451, 103, 104, 105; 68/5 C; D28/9; 132/201
See application file for complete search history.

(56) References Cited

U.S. PATENT DOCUMENTS 3,188,752 A * 6/1965 Skinner ..... 34/104
3,274,040 A * 9/1966 Chambers et al. ..... 156/258
3,320,681 A * 5/1967 Watlington ..... 34/90
3,327,404 A * 6/1967 Ganier ..... 34/554
3,376,656 A * 4/1968 Cavallo ..... 34/90
3,501,846 A * 3/1970 Melega et al. ..... 34/103
3,501,847 A * 3/1970 Sanford et al. ..... 34/103
3,608,203 A * 9/1971 Willat ..... 34/91
3,691,647 A * 9/1972 Snyder et al. ..... 34/104
3,757,429 A * 9/1973 Sumino ..... 34/103
3,828,588 A * 8/1974 Duncan ..... 68/5 C
3,958,340 A * 5/1976 Meyers ..... 34/259
4,162,580 A * 7/1979 Hess ..... 34/103
4,185,398 A * 1/1980 LaMont ..... 34/103
5,249,369 A * 10/1993 Mallet ..... 34/437
5,555,648 A * 9/1996 Griffin ..... 34/621
2003/0135937 A1* 7/2003 Barrass et al. ..... 8/408
2014/0130366 A1* 5/2014 Blum ..... 34/101
2014/0325863 A1* 11/2014 Blum ..... 34/101
2015/0075028 A1* 3/2015 Agoro ..... 34/509

FOREIGN PATENT DOCUMENTS

GB 1126621 * 9/1968

* cited by examiner

*Primary Examiner* — Steve M Gravini
(74) *Attorney, Agent, or Firm* — Decker, Jones P.C.; Brian K. Yost; Geoffrey A. Mantooth

(57) ABSTRACT

A wig drying apparatus and method are provided, the apparatus being adapted to support a wig and which may be used to direct air currents upward such that a wig may be dried quickly and easily without damaging the wig or unduly altering the wig's outer appearance, comprises, a stand adapted to hold a wig, the stand comprising a main body member comprising a base and a neck member, and upper members comprising a central member and side members. The neck member comprises a base tube comprising a base opening. The base opening is adapted to accept a hose/outlet portion of a dryer. In the preferred embodiment, the device's shape is generally that of a human head and neck. In one embodiment, the central member and base tube are removable and may be used to dry a wig not supported by the remaining portions of the stand.

20 Claims, 7 Drawing Sheets

WIG DRYING APPARATUS AND METHOD

FIELD OF THE INVENTION

The present invention relates generally to a wig dryer and specifically to an apparatus adapted to hold a wig and which may be used to direct air currents to dry the wig.

BACKGROUND OF THE INVENTION AND DESCRIPTION OF THE PRIOR ART

Wigs, or hair pieces, are often worn by persons seeking to change their appearance without the fuss and bother that may otherwise accompany visiting an expensive beauty parlor or hair salon. Wigs are made of strands of hair attached to a foundation—a sheet-like material that overlays a portion of the head of the wearer. The hair can be natural such as that from a human or an animal, or wigs may be synthetic, in which the hair strands are formed from manmade materials. Whether formed from natural or synthetic hair strands, wigs offer wearers a way to create a virtually unlimited number of looks, styles, colors, textures, lengths, and appearances that might otherwise be impractical or impossible.

Although wigs generally comprise several desirable features such as being generally easy to maintain, style, and wear, one drawback of wigs is that after a period of time, they become dirty and in need of cleaning. A common way to clean a wig involves detangling the strands, wetting the wig with water, applying a suitable cleaning product such as shampoo, applying a conditioner, rinsing the wig with water, and placing the wig on a towel, hair spray can, or wig stand to permit the wig to dry. Unfortunately, there is presently no easy way to quickly dry a wig. In most circumstances, measures such as wringing, squeezing, twisting, or rubbing the wig result in damage to the wig and/or cause matting and tangles. Those wearers attempting to use a hair dryer to dry the wig often find that the dryer fails to satisfactorily dry the wig in that the resulting wig may have an unattractive outward appearance and a damp foundation. Because of these problems and others, most wearers simply allow the wig to air dry over a period of time. Therefore, wearers are often forced to purchase additional wigs simply because of having to wait for a wet wig to dry. What is needed is an apparatus which may be used to hold a wig and which will facilitate and shorten the wig drying process.

The present disclosure provides a wig drying apparatus adapted to hold a wig and which may be used to direct air currents upward through the foundation such that a wig may be dried quickly and easily without damaging the wig or unduly altering the wig's outer appearance.

SUMMARY OF THE INVENTION

The present disclosure provides a wig drying apparatus adapted to hold a wig and which may be used to direct air currents upward through the foundation such that a wig may be dried quickly and easily without damaging the wig or unduly altering the wig's outer appearance. In the preferred embodiment, the apparatus comprises a stand portion adapted to hold a wig, the stand comprising a main body member comprising a base member and a neck member, and upper members comprising a central member and side members. The neck member comprises a base tube comprising a base opening. The base opening is adapted to accept a hose portion of a dryer. The base tube extends away from the base and towards a side tube manifold.

The central member comprises an upwardly extending curved contour. When viewed from a side, the central member comprises a contour comprising a hook configuration approximating a rear, crown, and forehead configuration of a human. The central member has a generally rectangular cross-section.

The side members each comprise curved contours and extend from respective sides of the stand from respective lower side member connection areas. Each side member has a generally rectangular cross-section.

Such lower side member connection areas are each positioned approximately midway between respective lower base and upper stand surfaces. Each side member extends upwardly from the respective lower side member connection area to respective upper side member connection areas. The upper side member connection areas are each adjacent to the crown portion of the central removable member.

Each side member is hingedly coupled to the main body portion at the lower side member connection area such that upper side member portions may be pivoted away from the central removable member.

The base tube manifold comprises one or more side branching tubes. The central member comprises one or more central branching tubes. The central branching tubes extend upward between sides of the central member.

The central and side branching tubes comprise a plurality of perforations extending from the branch tubes through outer surfaces of the central and side members. A wig positioned on the upper members can easily be dried. Air produced by a conventional and commercially available hair dryer is blown through base opening, into and through the base tube, upward through the neck and base and side tube manifolds, through the branching tubes, through the branching tubes perforations, and against an undersurface of a wig positioned on the outer surface of the upper member.

In one embodiment, the central member is removable. When removed and coupled to a hair dryer, the central member can be used to dry a wig by hand.

In other embodiments, the branching tubes comprise sub-branches in fluid communication with sub-branch perforations.

In other embodiments, the side members comprise a hook on the outside surface.

The present disclosure also presents a method of drying a wig, the method comprising the steps of providing a wig, a wig drying apparatus, and a hairdryer, the wig drying apparatus comprising a base member, a neck member, a central member and side members, the neck member comprising a base tube comprising a base opening; the base opening being adapted to accept a hose portion of the hairdryer; said base tube extending away from the base member and towards a branching portion; said branching portion comprising said base tube and one or more side branching tubes; the side branching tubes extending upward between sides of the neck and side members; the central member comprising one or more central branching tubes extending between sides of the central member, the central and side branching tubes comprising a plurality of perforations extending from branching tubes through outer surfaces of the wig drying apparatus; positioning the wig on the wig drying apparatus; and directing air from the hairdryer into the base opening.

In other embodiments of the method, the method comprising the steps of providing a wig, a wig drying apparatus, and a hairdryer, the wig drying apparatus comprising a base member, a neck member, a removable central member and side members, the neck member comprising a base tube comprising a base opening; the base opening being adapted to accept a hose portion of the hairdryer; said base tube extending away from the base member and towards a branching portion; said branching portion comprising said base tube and one or more side branching tubes; the side branching tubes extending upward between sides of the neck and side members; the central member comprising one or more central branching tubes extending between sides of the central member, the central and side branching tubes comprising a plurality of perforations extending from branching tubes through outer surfaces of the wig drying apparatus; removing the central member, and drying the wig with the central member.

In other embodiments of the method, the central and side branching tubes comprise sub-branches in fluid communication with sub-branch perforations.

In other embodiments of the method, the perforations on the outer surfaces of the wig drying apparatus are configured to permit air to be directed to the majority of the underside of the wig.

In other embodiments of the method, the perforations on the outer surface of the stand are configured to permit air to be directed to the majority of the underside of the wig.

DESCRIPTION OF THE PREFERRED EMBODIMENT

Figure 1:
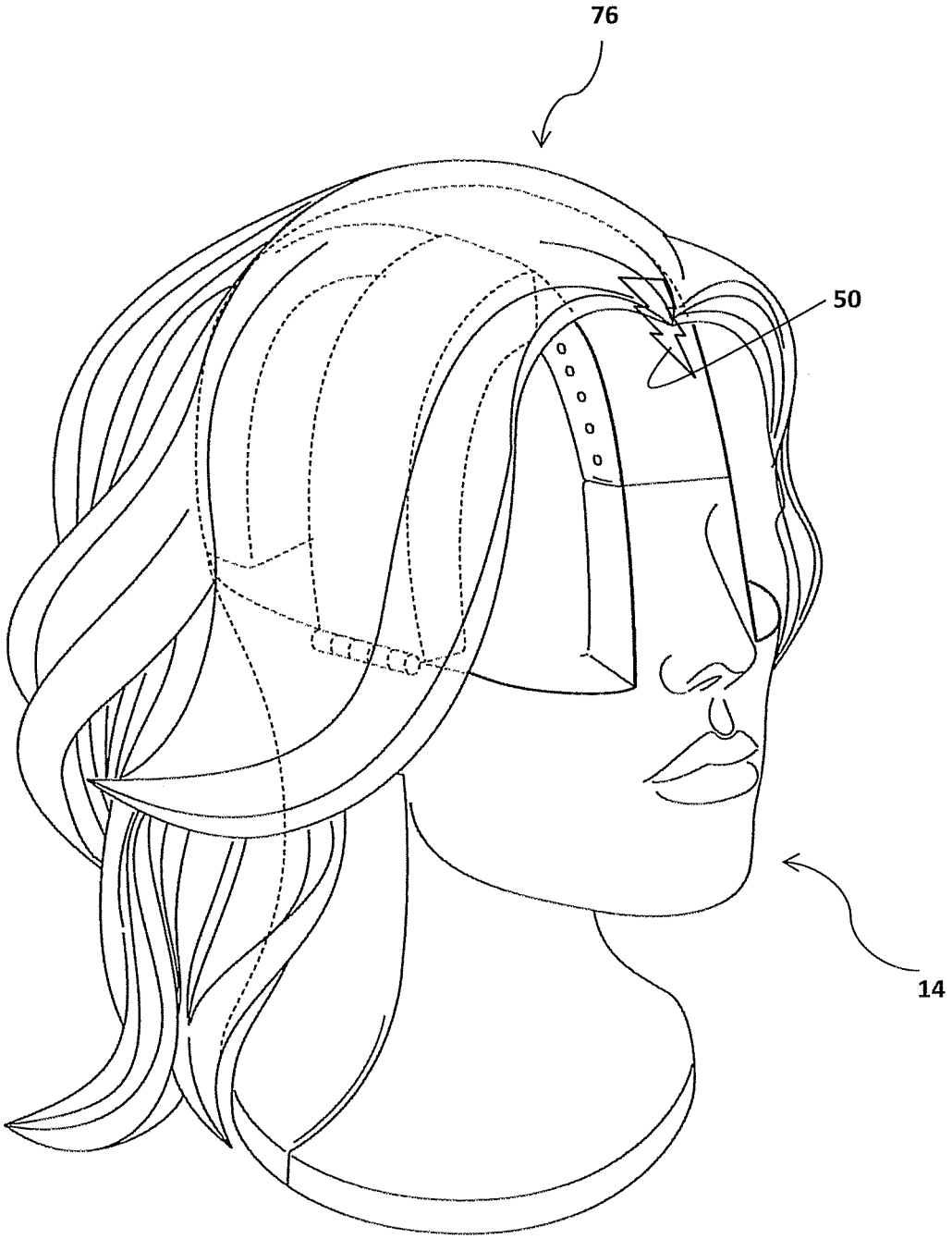
FIG. 1 is a left, front, and top side isometric view of the wig drying apparatus and wig in accordance with a preferred embodiment

A preferred embodiment of the device 14 is presented in the figures referenced above. In describing the embodiments of the invention, specific terminology will be used for the sake of clarity. However, the invention is not intended to be limited to the specific terms so selected, it being understood that each specific term includes all technical equivalents operating in a similar manner to accomplish a similar purpose. It is understood that the drawings are not drawn exactly to scale. In the drawings, similar reference numbers are used for designating similar elements throughout the several drawings.

This specification and appended claims describe particular embodiments of the invention. However, it should be understood, based on this disclosure, that the invention is not limited to the embodiments detailed herein. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C" An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, aspects, adaptations, variations, alternatives, and uses of the invention, including what is presently believed to be the best mode of carrying out the invention.

The examples and illustrations of a wig drying apparatus and method are described herein with respect to wig drying apparatus for use in the home. However, the inventive system is equally applicable for use in professional salons by professional hair stylists and beauticians or in other environments. Moreover, while certain materials are discussed herein with respect to various components of the various embodiments, the embodiments are not limited to such materials. For example, in a preferred embodiment, certain components are formed from extruded polystyrene foam such as Styrofoam® or polyethylene, polypropylene, polyvinyl chloride, polytetrafluoroethylene (PTFE) or other suitable synthetic material. However, as will be discussed in more detail below, the components of the device may comprise any natural or man-made suitable materials, including metal, glass, or materials formed from a variety of polymers, monomers, and co-polymers, without departing from the scope and spirit of this disclosure.

Figure 2:
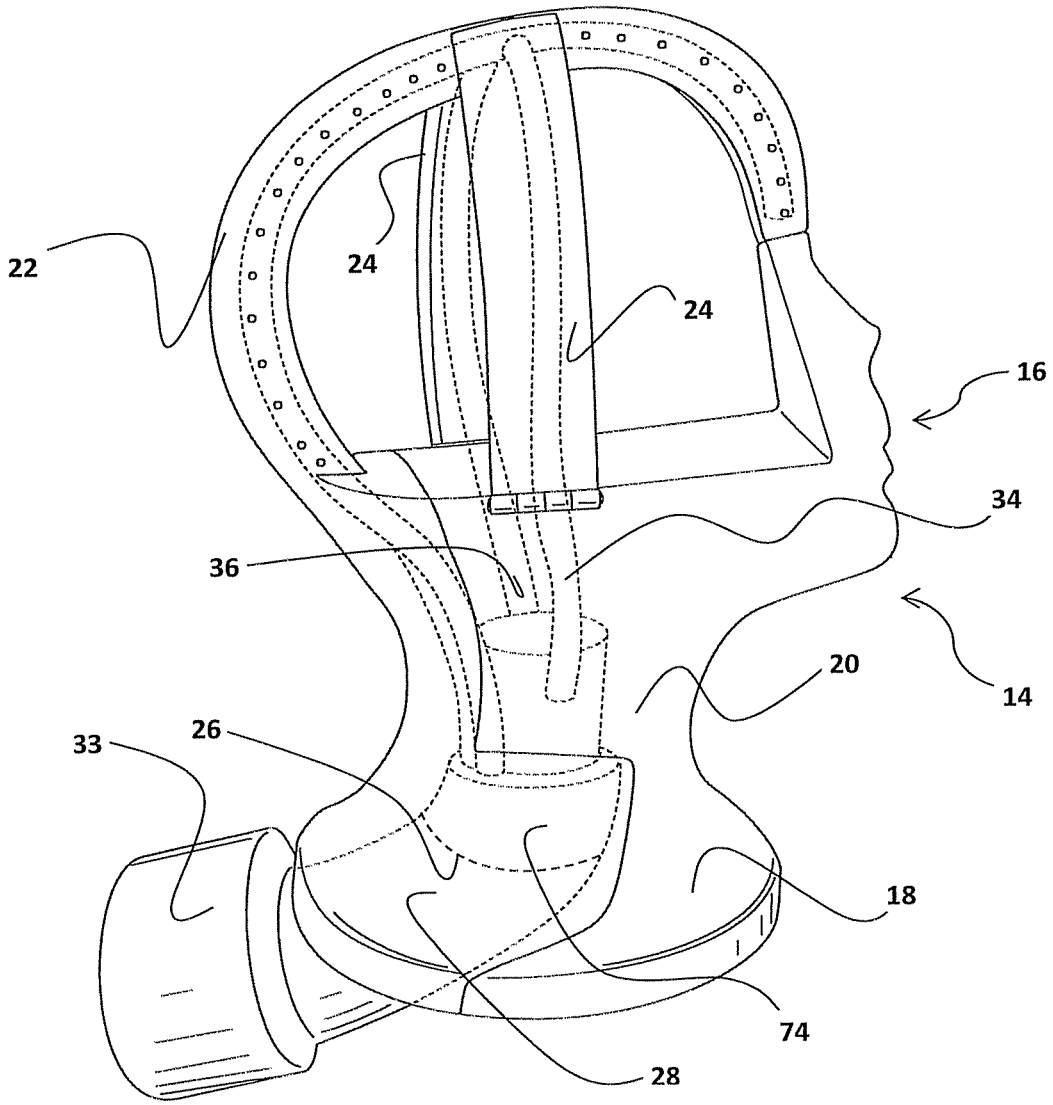
FIG. 2 is a right side perspective view of the wig drying apparatus with the wig removed and a hair dryer attachment inserted within the base, in accordance with a preferred embodiment.

Referring to FIG. 1, in a preferred embodiment of the present invention, the device 14 generally comprises a stand 14 adapted to hold a wig 76. Referring to FIG. 2, the stand 14 comprises a main body member 16 comprising a base 18 and a neck member 20, and upper members 22, 24 comprising a central member 22 and side members 24. The neck member 20 comprises a base tube 74 comprising a base opening 26. The base opening 26 is adapted to accept a hose/outlet portion 28 of a dryer 30 or a dryer attachment 33. In the preferred embodiment, the device 14 comprises a shape that is generally that of a human head and neck.

Figure 5:
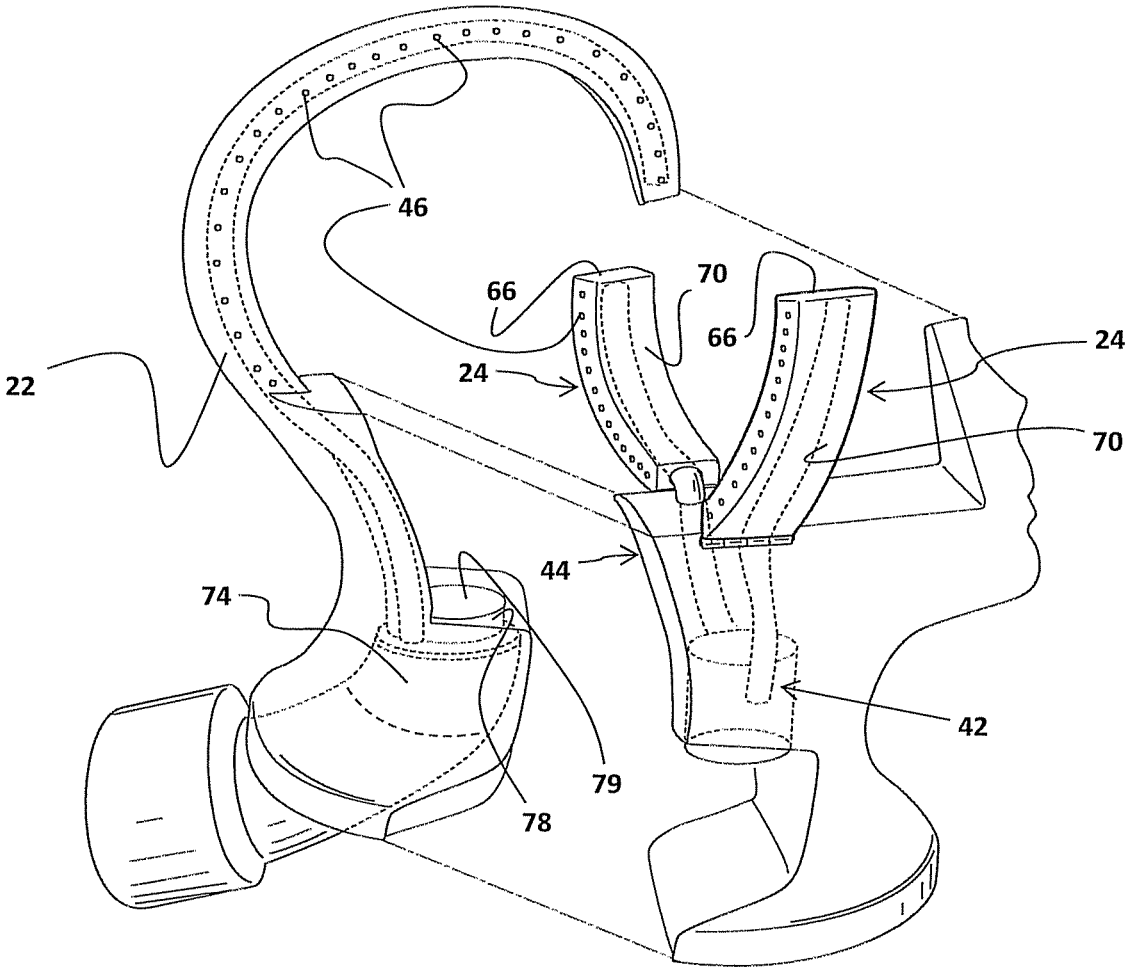
FIG. 5 is a right side perspective view of the wig drying apparatus of FIG. 2 with the central member and base tube removed, in accordance with a preferred embodiment.
Figure 6:
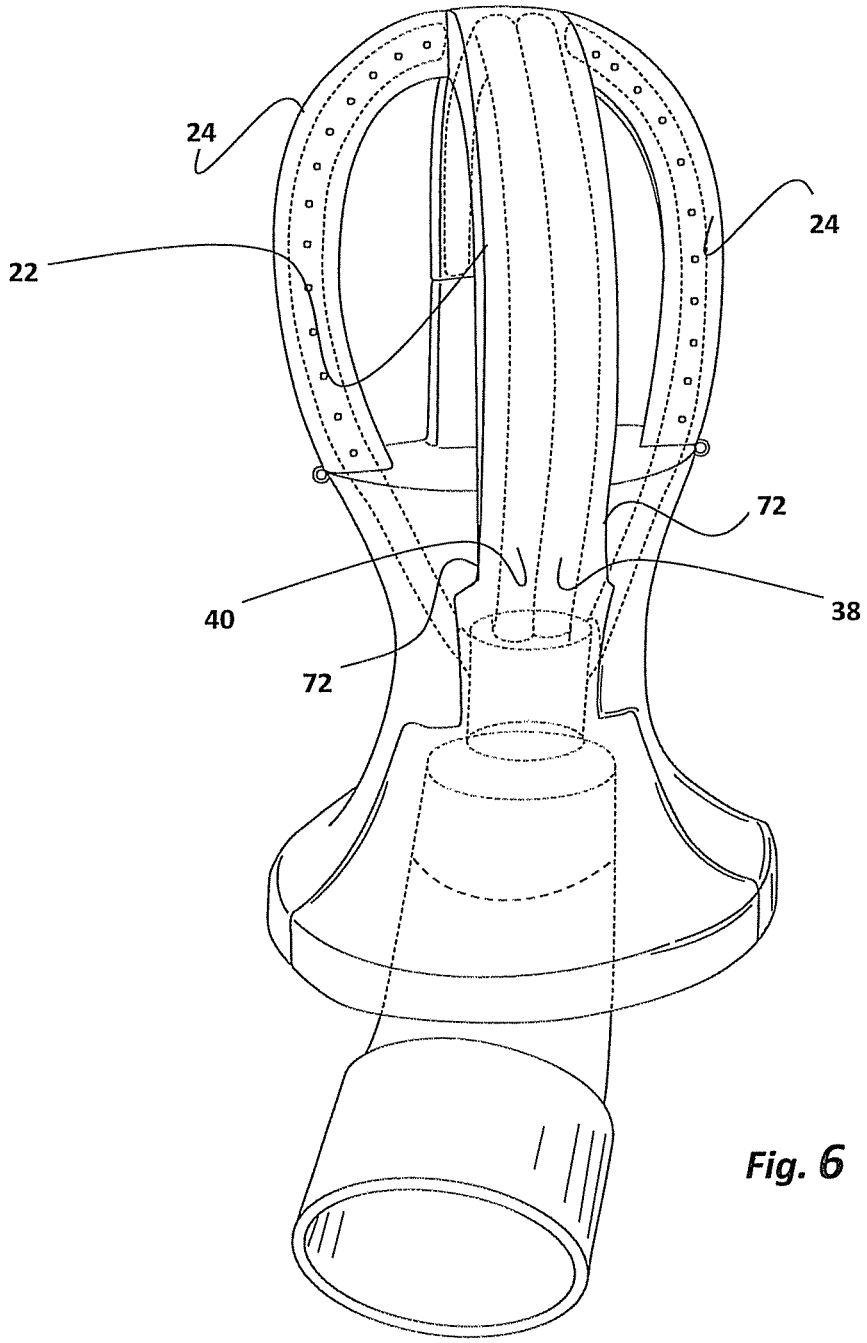
FIG. 6 is a rear perspective view of the wig drying apparatus of FIG. 2.
Figure 7:
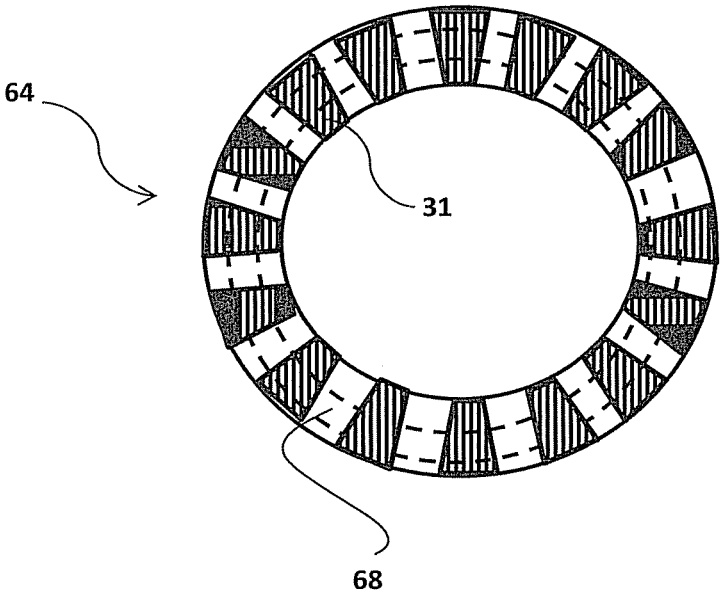
FIG. 7 is an underside elevation view of the base opening of wig drying apparatus of FIG. 2, in accordance with a preferred embodiment.

Referring to FIGS. 2 and 5, in the preferred embodiment, the base tube 74 is circular and comprises an approximate two inch diameter. With this diameter, base tube 74 is adapted to receive a standard sized hose/outlet portion 28 of a hairdryer 30. Referring to FIG. 7, the base opening 26 of the preferred embodiment comprises a tapered portion 64 comprising flexible members 31 which move towards a base tube 74 perimeter when the hose/outlet portion 28 is inserted within the base tube 74 through the base opening 26. Therefore, tapered portion 64 acts as a funnel so that the hose/outlet portion 28 may easily be inserted within the base tube 74. Although in the preferred embodiment, the base tube opening 26 is positioned on a lower surface of the base member 18 and is approximately two inches in diameter, the base tube opening 26 need not be positioned on a lower surface of the base member 18 and may be smaller or larger than approximately two inches in diameter. For example, the base tube opening 26 may be positioned on other surfaces of the device 14 and may be configured to receive hose/outlet portions 28 of varying diameters. In the preferred embodiment, base tube 74 and flexible members 31 are formed from plastic. Flexible members 31 are biased in a constricted position so that when the hose/outlet portion 28 is inserted within opening, the hose/outlet portion 28 is securely retained within the base tube 74. An elastic band 68 surrounding the perimeter of the base tube 74 and exterior portions of flexible members 31 exerts inward pressure on the flexible members 31 to maintain the flexible members 31 in inwardly biased configuration. Other hose coupling means known in the art may also be used without departing from the scope and spirit of the present disclosure.

Referring to FIGS. 2-6, the central member 22 comprises an upwardly extending curved contour. When viewed from a side, the central member 22 comprises a contour comprising a hook configuration approximating a rear, crown, and forehead configuration of a human. In the preferred embodiment, the central member 22 comprises a generally rectangular cross-section.

Figure 3:
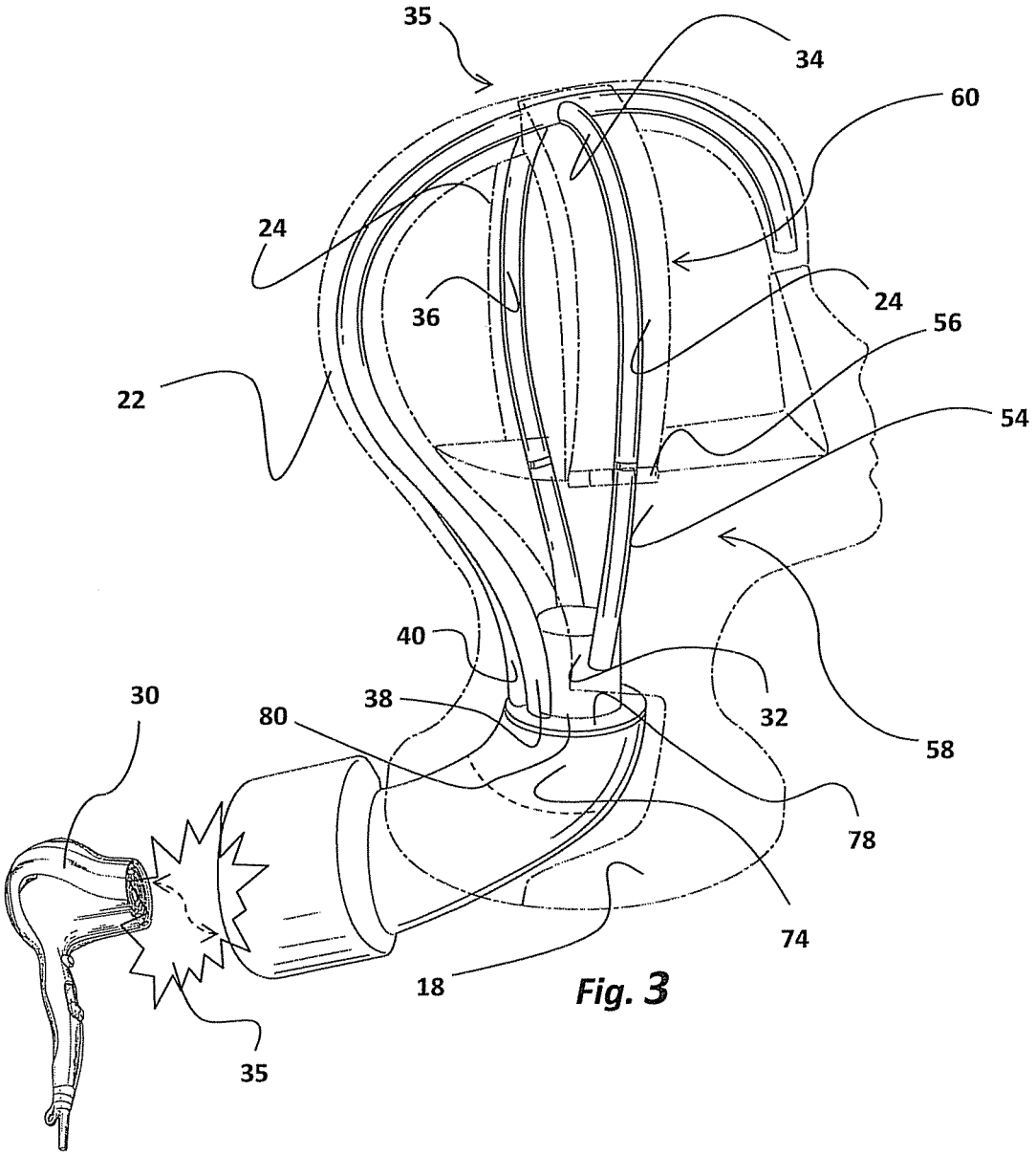
FIG. 3 is right side perspective view of the wig drying apparatus with the wig removed and the outer surface drawn in phantom, in accordance with a preferred embodiment.
Figure 4:
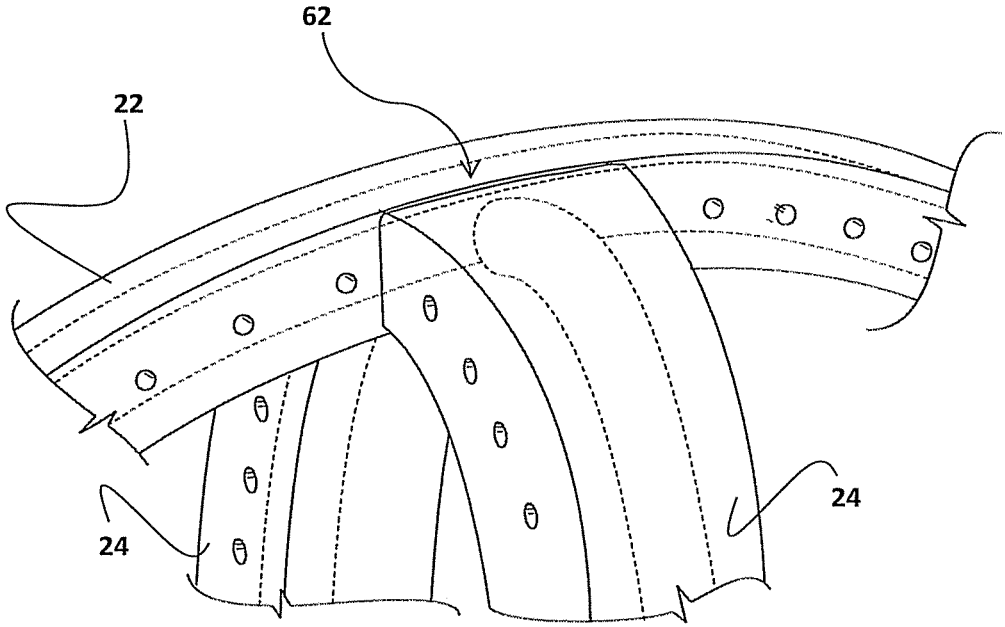
FIG. 4 is a right and upper side perspective view of the intersection between the side members and central member.

The side members 24 each comprise curved contours and extend from respective sides 54 of the stand 14 from respective lower side member connection areas 56 (FIG. 3). In the preferred embodiment, each side member 24 comprises a generally rectangular cross-section.

Such lower side member connection areas 56 are each positioned approximately midway between respective lower base and upper stand surfaces 58, 60. Each side member 24 extends upwardly from the respective lower side member connection area to respective upper side member connection areas 62. The upper side member connection areas 62 are each adjacent to a crown portion 31 of the central member 22.

As best shown in FIG. 5, in the preferred embodiment, each side member 24 is hingedly coupled to the main body portion at the lower side member connection area 56 such that upper side member portions 66 may be pivoted away from the central member 22.

Referring to FIG. 3, the base tube 74 of the preferred embodiment further comprises a base tube manifold 78 at an upper end of the base tube 74. The base tube 74 of the preferred embodiment extends away from the base member 18 and towards a side tube manifold 32 to which the base tube manifold 78 sealingly adjoins. The base tube manifold 78 comprises one or more central branching tubes 38, 40 and an upper base tube opening 80. The upper base tube opening 80 leads to the side tube manifold 32.

The side tube manifold 32 comprises one or more side branching tubes 34, 36. The side branching tubes 34, 36, extend upward between sides 42, 44 of the neck member 20 (see FIG. 5) and respective sides 70 of side members 24. The central member 22 comprises one or more central branching tubes 38, 40. The central branching tubes 38, 40 extend upward between sides 72 of the central member 22. Referring to FIG. 5, the central and side branching tubes 34, 36, 38, 40 comprise a plurality of perforations 46 extending from the branching tubes 34, 36, 38, 40 through outer surfaces of the central and side members 22.

A wig 76 positioned on the upper member can easily be dried. Air 35 produced by a conventional and commercially available hairdryer 30 is blown through base opening 26, into and through the base tube 74, upward through the neck 20 and a base tube and side tube manifolds 78 32, through the branching tubes 34, 36, 38, 40, through the branching tube perforations 46, and against an undersurface 48 of a wig 76 positioned on the outer surface 48 of the upper member 22.

Referring to FIG. 5, in the preferred embodiment, the central member 22 and base tube 74 are removable. When removed and coupled to a hair dryer 30, the central member 22 can be used to dry a wig 76 by hand. In this embodiment, the central member 22 nests between the side members 24 and sides of the base 18. When the central member 22 and base tube 74 are removed, a base tube manifold 78 valve 79 may be closed such that air will not be directed through the upper base tube opening 80.

In other embodiments, the central member 22 comprises a hooking member 50 on the outer surface 48 which permits the wig 76 to be secured. Although the central member 22 and base tube 74 of the preferred embodiment are removable, the central member 22 and base tube 74 need not be removable. In other embodiments, for example, the central member 22 and base tube 74 are fixed to the base 18 and side members 24. In such embodiments, the base tube manifold 78 can be eliminated, and the base tube manifold 78 may comprise the central branching tubes 38, 40 as well as the side branching tubes 34, 36.

Although in the preferred embodiment, the central member 22 comprises two central branching tubes 38, 40 the device 14 may comprise more or fewer than two central branching tubes 38, 40. For example, in one embodiment, the central member 22 comprises a single branching tube 38. In other embodiments, the central member comprises three or more central branching tubes 38, 40.

Although in the preferred embodiment, the side members 24 each comprise a single side branching tube 34, 36 the side members 24 may comprise no side branching tubes 34, 36 or more than one central branching tubes 34, 36. For example, in one embodiment, the side members 22 each comprise two branching tubes 34, 36. In other embodiments, the side members 24 comprise two or more side branching tubes 34, 36. Moreover, the side members 24 need not comprise the same number of branching tubes 34, 36 as each other 24.

In other embodiments, the central and side branching tubes 34, 36, 38, 40 comprise sub-branches in fluid communication with sub-branch perforations 46.

The present disclosure also presents a method of drying a wig 76, the method comprising the steps of providing a wig 76, a wig drying apparatus 14, and a hairdryer 30, the wig drying apparatus 14 comprising a base member 18, a neck member 20, a central member 22 and side members 74, the neck member 20 comprising a base tube 74 comprising a base opening 26; the base opening 26 being adapted to accept a hose portion 28 of the hairdryer 30; said base tube 74 extending away from the base member 18 and towards a side tube manifold 32; said side tube manifold 32 comprising said base tube 74 and one or more side branching tubes 34, 36; the side branching tubes 34, 36 extending upward between sides 42, 44 of the neck and side members 20, 24; the central member 22 comprising one or more central branching tubes 38, 40 extending between sides of the central member 22, the central and side branching tubes 34, 36, 38, 40 comprising a plurality of perforations 46 extending from branching tubes 34, 36, 38, 40 through outer surfaces 48 of the wig drying apparatus 14; positioning the wig 76 on the wig drying apparatus 14; and directing air 52 from the hairdryer 30 into the base opening 26.

In other embodiments of the method, the method comprising the steps of providing a wig 76, a wig drying apparatus 14, and a hairdryer 30, the wig drying apparatus 14 comprising a base member 18, a neck member 20, a removable central member 22 and side members 74, the neck member 20 comprising a base tube 74 comprising a base opening 26; the base opening 26 being adapted to accept a hose portion 28 of the hairdryer 30; said base tube 74 extending away from the base member 18 and towards a side tube manifold 32; said side tube manifold 32 comprising said base tube 74 and one or more side branching tubes 34, 36; the side branching tubes 34, 36 extending upward between sides 42, 44 of the neck and side members 20, 24; the central member 22 comprising one or more central branching tubes 38, 40 extending between sides of the central member 22, the central and side branching tubes 34, 36, 38, 40 comprising a plurality of perforations 46 extending from branching tubes 34, 36, 38, 40 through outer surfaces 48 of the wig drying apparatus 14; removing the central member 22, and drying the wig with the central member 22.

In other embodiments of the method, the central and side branching tubes 34, 36, 38, and 40 comprise sub-branches in fluid communication with sub-branch perforations 46.

In other embodiments of the method, the perforations 46 on the outer surfaces 48 of the wig drying apparatus 14 are configured to permit air 52 to be directed to the majority of the underside of the wig 76.

The foregoing disclosure and showings made in the drawing are merely illustrative of the principles of this invention and are not to be interpreted in a limiting sense. While the invention is shown in only a few forms, it is not just limited to the forms shown, but is susceptible to various changes and modifications without departing from the spirit thereof. The foregoing description of a preferred embodiment of the invention has been presented for the purpose of illustration and description. It is not intended to be exhaustive or to limit the invention to the precise form disclosed. Obvious modifications or variations are possible in light of the above teachings. The invention may be adapted for use in a number of environments.

The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention in accordance with the breadth of this disclosure, to which it is fairly, legally, and equitably entitled to be interpreted.

I claim:

1. A wig drying apparatus comprising:

a main body portion and upper members;

said main body portion comprising a base member and a neck member;

said upper members comprising a central upper member and side members;

the base member comprising a base tube comprising a base opening;

the base opening being adapted to accept an air outlet portion of a hairdryer;

said base tube extending away from the base member and towards a side tube manifold;

said side tube manifold comprising one or more side branching tubes;

the one or more side branching tubes being positioned between sides of the neck member and between sides of said side members;

the central member comprising one or more central branching tubes positioned between sides of said central member; and wherein one or more of the central and side branching tubes comprising a plurality of perforations extending to an outer surface of the wig drying apparatus.

2. The wig drying apparatus of claim 1, the said one or more central and side branching tubes being in fluid communication with said base opening.

3. The wig drying apparatus of claim 1, the central member being removable.

4. The wig drying apparatus of claim 3, the base tube being removable.

5. The wig drying apparatus of claim 3, one or more of said side tubes being hingedly coupled to one or more main body side portions.

6. The wig drying apparatus of claim 1, the upper members arching inwardly above said neck member.

7. The wig drying apparatus of claim 6, the upper members forming a cavity above said neck member.

8. The wig drying apparatus of claim 1, the branching tubes comprising sub-branches in fluid communication with sub-branch perforations.

9. The wig drying apparatus of claim 1, further comprising a hook, the hook being positioned on said outer surface.

10. The wig drying apparatus of claim 1, the apparatus generally comprising a shape of a human head.

11. A method of drying a wig, the method comprising the steps of:

providing a wig and a wig drying apparatus, the wig drying apparatus comprising a main body portion and upper members;

said main body portion comprising a base member and a neck member;

said upper members comprising a central upper member and side members;

the base member comprising a base tube comprising a base opening;

the base opening being adapted to accept an air outlet portion of a hairdryer;

said base tube extending towards a side tube manifold;

said side tube manifold comprising one or more side branching tubes;

the one or more side branching tubes being positioned between sides of the neck member and between sides of said side members;

the central member comprising one or more central branching tubes positioned between sides of said central member; and wherein one or more of the central and side branching tubes comprising a plurality of perforations extending to an outer surface of the wig drying apparatus;

the branching tubes comprising a plurality of perforations extending from branching tubes through outer surface of the wig drying apparatus;

positioning the wig on the wig drying apparatus; and directing air from the hairdryer into the base opening.

12. The method of claim 11, the said one or more central and side branching tubes being in fluid communication with said base opening.

13. The method of claim 11, the central member being removable.

14. The method of claim 13, the base tube being removable.

15. The method claim 13, one or more of said side tubes being hingedly coupled to one or more main body side portions.

16. The method of claim 11, the upper members arching inwardly above said neck member.

17. The method of claim 16, the upper members forming a cavity above said neck member.

18. The method of claim 11, the branching tubes comprising sub-branches in fluid communication with sub-branch perforations.

19. The method of claim 11, further comprising a hook, the hook being positioned on said outer surface.

20. The method of claim 11, the apparatus generally comprising a shape of a human head.

* * * * *